United States Patent [19]

Graham

[11] Patent Number: 4,489,444

[45] Date of Patent: Dec. 25, 1984

[54] GOLF BALL MARKER HOLDER

[76] Inventor: James E. Graham, 2799 Delk Rd., Marietta, Ga. 30067

[21] Appl. No.: 433,435

[22] Filed: Dec. 6, 1982

[51] Int. Cl.[3] ..... A41D 19/00

[52] U.S. Cl. ..... 2/160; 2/161 A

[58] Field of Search ..... 2/160, 161 A

[56] References Cited

U.S. PATENT DOCUMENTS

| | | | |
|---|---|---|---|
| 3,588,917 | 6/1971 | Antonious | 2/161 A |
| 3,847,110 | 11/1974 | Inoue | 2/161 A |
| 4,040,126 | 8/1977 | Cecil | 2/161 A |
| 4,051,552 | 10/1977 | Widdemer | 2/161 A |
| 4,236,658 | 12/1980 | Kallman | 2/DIG. 6 |
| 4,280,287 | 7/1981 | Gulbransen | 2/DIG. 6 |

*Primary Examiner*—Louis K. Rimrodt

*Attorney, Agent, or Firm*—Thomas & Kennedy

[57] ABSTRACT

A golf ball position marker holder has a pad joined with a flap with confrontable surfaces of the pad and flap formed of materials that interlock so as to releasibly grip one another. The flap has an aperture of a size and shape such that the spike of the ball marker may extend therethrough while its base may not.

6 Claims, 3 Drawing Figures

GOLF BALL MARKER HOLDER

TECHNICAL FIELD

This invention relates generally to sports equipment and particularly to devices for holding golf ball markers.

BACKGROUND OF THE INVENTION

In the game of golf a player's ball on a green will often lie within or close to the path between the cup and the ball position of another player. To overcome this interference or stymie, and to avoid distraction, the player with the interferring ball will mark its position and then temporarily remove the ball from the putting surface of the green. This marking is typically done with a plastic ball marker in the form of a disc-shaped base from one principal surface of which a short spike or tit projects. Once pressed to the green the spike penetrates the soil so as to anchor the marker in place while the base provides a smooth surface over which other players' balls may roll without impairment to their roll speed or direction.

Though ball markers of the type described function well they are somewhat cumbersome to use. Specifically, when not in use they typically are carried in a pocket of a player's trousers or skirt. However, since they are generally of the same size and feel as some coins, such as pennies and dimes, which also are carried in the pockets, and since they are usually mixed with golf tees in the pockets, they are not readily retrievable. Thus, a player will often have to fumble about in trying to locate one in his pocket right at a time when other players are waiting for him to mark his ball.

Heretofore, devices and items of wearing apparel have been developed for holding golf accessories such as ball markers and tees while not in use. For example, U.S. Pat. No. 3,895,797 teaches a golf ball marker having a surface formed of a non-woven fibrous material that forms a soft mat similar in texture to the grass of a green. A pad faced with resilient hooks for temporary locking connection with the non-woven fibers is provided that may be attached to the visor of a cap. Unfortunately, though such may be used with facility it is done so at a substantial increase in cost. Moreover, many players, who have traditionally used coins as markers, or smooth plastic markers, question their effect upon ball roll.

U.S. Pat. No. 4,069,954 discloses a wrist band type of golf accessory holder formed with elastic tapes. Again, though the device does work it is an independent accessory in itself that must be purchased and worn. Many golfers feel uncomfortable in wearing such a band, loaded with accessories, on their wrists while executing golf swings. Furthermore, fastening and releasing a marker from the bands requires a substantial degree of dexterity since the markers must be seated and unseated between the loops much as one fastens and unfastens a button from a button hole—but all done with only one hand.

Accordingly, it is seen that there remains a need for a device or apparatus for holding golf ball markers that would be simple to use, inexpensive, and which would not necessarily constitute an item of apparel in addition to that normally worn by golfers. It is to the fulfillment of this need that the present invention is primarily directed.

SUMMARY OF THE INVENTION

In a preferred form of the invention a holder for holding a golf ball position marker having a disc-shaped base from one side of which a spike projects comprises a pad joined with a flap such that the flap may be removably positioned upon the pad, and with confrontable surfaces of the pad and flap respectively formed of fibrous materials that interlock so as to releasibly grip one another. The flap has an aperture of a size and shape such that the spike of the golf ball marker when seated upon the pad may extend therethrough once the flap is placed upon the pad but the marker base may not be passed readily therethrough.

DETAILED DESCRIPTION

Figure 1:
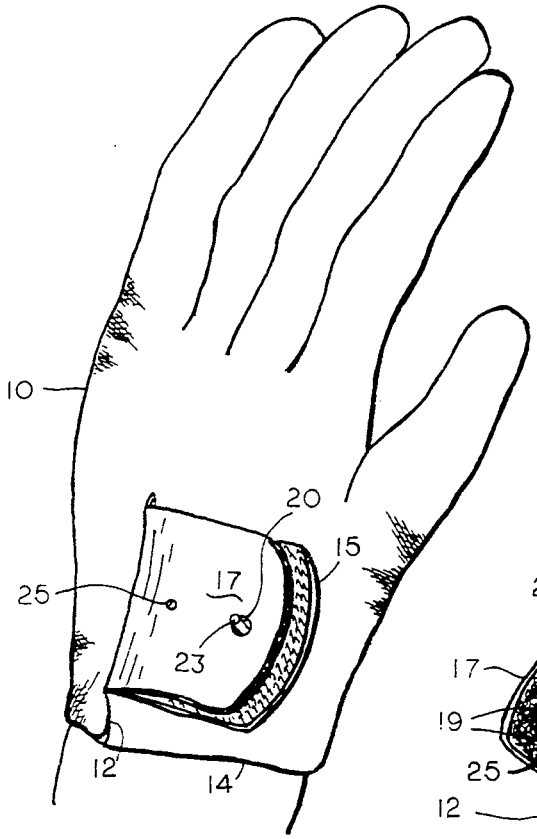
FIG. 1 is a perspective view of a golf glove worn upon a golfer's hand having a holder attached thereto, shown in a closed position, which incorporates principles of the present invention.
Figure 2:
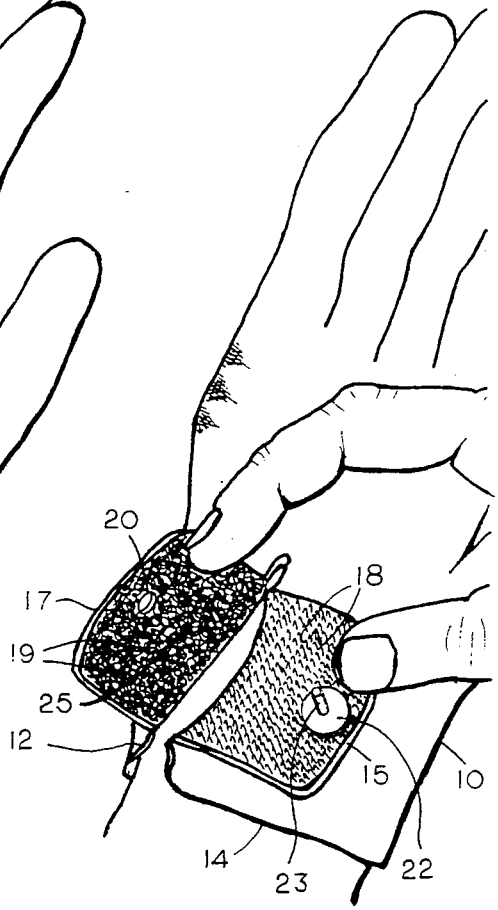
FIG. 2 is the same view as that illustrated in FIG. 1 but with the holder shown in an open position.

Referring now in more detail to the drawing, there is shown in FIGS. 1 and 2 a golf glove 10 having a seam 12 that extends from a hand entry end 14. A pad 15 is secured as by adhesive or stitches to the glove extending from one side of the seam. A flap 17 is also secured to the glove along the other side of the seam, as by stitching, so as to be hingedly attached. The upper surface of the pad 15 is formed of a material having a mass of hook-like fibers 18 projecting from its surface while the bottom surface of the flap is formed of a mass of non-woven fibers 19. These materials, whose locations may be reversed, cooperate with one another when placed together in a gripping fashion and are commercially available under the trademark Velcro. Thus far described, the golf glove is of conventional construction.

With continued reference to FIGS. 1 and 2 the flap 17 is seen to be provided with a round hole or aperture 20 whose diameter is less than that of the disc-shaped base portion of a golf ball position marker 22, shown seated upon the pad 15, but whose diameter is greater than the width of the marker spike 23. Though the aperture is here shown to be round or circular it may be of the shapes such as, for example, in the form of an elongated slot, so long as the marker spike may be passed easily therethrough while the marker base may not. Finally, the flap 17 is also seen to be provided with a smaller, auxiliary hole or aperture of a shape and size such as to receive and frictionally hold the marker spike 23.

In use, a golfer wearing the glove 10 may place the marker 22 beneath the flap 17 with the marker spike extending through the aperture 20 and then fold the flap 17 down upon the pad as shown in FIG. 1. In this configuration the flap adheres to the pad by mechanical interlock of their confronting materials. This action serves both to hold the glove securely to the golfer's hand and also to hold the marker in place. Whenever the golfer should have need for the marker he may peel back the flap partially off of the pad, take the ball position marker, and mark his position. The flap may then be folded back into full contact with the pad or left in a position slightly lifted. Once the player has replaced his ball on the putting surface and retreived the marker he may lift the flap 17 again, if it was not left in a slightly lifted orientation, reposition the marker beneath the flap 17 with the marker spike extending through aperture 20, and then fold the flap back upon the pad. This procedure may be repeated during the course of play many times. Then, when the glove is removed with the flap left open, the marker spike may be passed through the smaller, auxiliary hole 25 so that it becomes frictionally held to the holder and glove.

Figure 3:
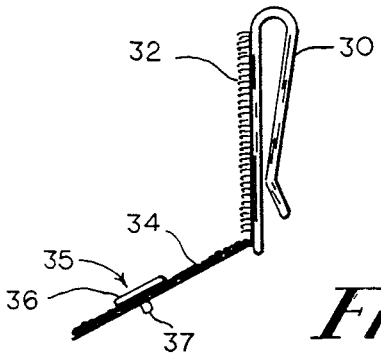
FIG. 3 is a side elevational view of a holder embodying principles of the invention in another form.

The holder need not, of course, be mounted to a golf glove but may be attached to other apparel such as shirts, trousers and skirts in a manner such that the holder pad and flap are joined for mutual cooperation as just described. Such apparel need not, however, provide the means for joining the flap to the pad. In FIG. 3, for example, another holder embodying the invention is seen to be comprised of a resilient clip 30 flush to one surface of which is secured a pad 32 formed of the same Velcro material as the pad in FIGS. 1 and 2. A flap 34 is hingedly attached to lower edges of the clip and pad. The flap too is formed of the same Velcro material as the flap in the other FIGS. A marker 35 is shown with its disc-shaped base 36 seated upon the flap and with its spike 37 extending through as unshown hole in the flap. Again, the hole here is of a size and shape as to accomodate the spike loosely but through which the base may not easily pass. As shown in FIG. 3 the holder is in an open position with the clip oriented such as it would be when attached to a golfer's belt. To close the holder the flap is merely folded upwardly into flush contact with the pad.

It thus is seen that a holder is provided which well fills a need that has existed for many years in the sport of golf. It should be understood, however, that the invention has been illustrated only in two specific forms. Many modifications, additions and deletions may, of course, be made thereto without departure from the spirit and scope of the invention as set forth in the following claims.

What is claimed is:

1. A holder for holding a golf ball position marker having a disc-shaped base from one side of which a spike projects, and with said holder comprising a pad permanently joined with a flap such that the flap may be removably positioned upon said pad, and with confrontable surfaces of said pad and flap being respectively formed of fibrous materials that interlock so as to releasibly grip one another, and with said flap having an aperture of a size and shape such that the spike of the golf ball position marker when seated upon the pad may extend therethrough once the flap is placed upon the pad but the marker base may not be passed therethrough.

2. A golf ball position marker holder in accordance with claim 1 further comprising a golf glove to which said pad and flap are secured whereby the pad and flap are joined together by the glove.

3. A golf ball position marker holder in accordance with claim 1 further comprising a clip to which said pad is secured.

4. A golf ball position marker holder in accordance with claim 1 wherein said flap has a second aperture of a size and shape such that the spike of a golf ball position marker may be positioned and held therein by frictional engagement.

5. A golf ball position marker holder in accordance with claim 1 in combination with a golf ball position marker formed of a material that does not interlock with the flap or pad materials.

6. The golf ball position marker and marker holder combination of claim 5 wherein said marker is composed essentially of a plastic material.

* * * * *